US007182696B2

(12) United States Patent
Wyeth

(10) Patent No.: US 7,182,696 B2
(45) Date of Patent: Feb. 27, 2007

(54) BALL FEEDER

(76) Inventor: Martin Wyeth, 42 North Street, Old Town, Wiltshire (GB) SN1 3JY ( * ) Notice: Subject to any disclaimer, the term of this patent is extended or adjusted under 35 U.S.C. 154(b) by 374 days.

(21) Appl. No.: 10/799,649

(22) Filed: Mar. 15, 2004

(65) Prior Publication Data

US 2004/0192456 A1 Sep. 30, 2004

(30) Foreign Application Priority Data

Mar. 28, 2003 (GB) ..... 0307162.8

(51) Int. Cl.
*A63B 69/36* (2006.01)

(52) U.S. Cl. ..... 473/132

(58) Field of Classification Search ..... 473/132–137
See application file for complete search history.

(56) References Cited

U.S. PATENT DOCUMENTS

| | | | | |
|---|---|---|---|---|
| 2,520,952 A | | 9/1950 | Mozel | |
| 2,948,536 A | * | 8/1960 | Koener | 473/137 |
| 3,666,268 A | | 5/1972 | Candusso | |
| 3,870,239 A | | 3/1975 | Lautzenheiser et al. | |
| 4,441,717 A | * | 4/1984 | Willcox | 473/134 |
| 4,602,789 A | | 7/1986 | Chung | |
| 5,071,131 A | * | 12/1991 | Turnidge et al. | 473/137 |
| 5,351,964 A | * | 10/1994 | Kruger | 473/136 |
| 5,390,931 A | | 2/1995 | Chiasson | |

FOREIGN PATENT DOCUMENTS

| | | |
|---|---|---|
| DE | 298 07 195 | 6/1998 |
| FR | 2 635 269 | 2/1990 |
| FR | 2 732 228 | 10/1996 |
| GB | 1180638 | 2/1970 |
| GB | 2 224 216 | 5/1990 |
| JP | 4-164474 | 6/1992 |
| SU | 1701405 | 12/1991 |

* cited by examiner

*Primary Examiner*—Steven Wong
(74) *Attorney, Agent, or Firm*—Young & Thompson

(57) ABSTRACT

A ball feeder comprises a funnel having a base, opposing side walls, a ball inlet end and a ball outlet end. The base is inclined to define a ramp extending downwards from the inlet end to the outlet end and the side walls diverge in width from the inlet end to the outlet end. The ball feeder also comprises a scoop for receiving a single transverse row of balls at the outlet end of the funnel and means for raising the scoop into an elevated position in which it defines a second ramp extending transversely of the first mentioned ramp and in which it can release the balls one at a time. The raising means may also raise and lower a tee.

11 Claims, 2 Drawing Sheets

BALL FEEDER

This invention relates to a ball feeder and more particularly, but not exclusively, to a feeder for feeding balls one at a time to a golf tee.

It is known to provide a golf driving range with a mechanism for automatically feeding golf balls to a golf tee. Known mechanisms have a ball engine which receives balls from a hopper and which delivers the balls one at a time to the tee. The problem with such a mechanism is that the balls wedge or bridge in the hopper and it is necessary to provide a vibrating or prodding mechanism to release them. This can be relatively expensive.

The present invention seeks to provide a ball feeder which is relatively cheap to manufacture.

SUMMARY OF THE INVENTION

According to the invention there is provided a ball feeder comprising a funnel having a base, opposing side walls, a ball inlet end and a ball outlet end, the base being in use inclined to define a ramp extending downwards from the inlet end to the outlet end and the side walls diverging in width from the inlet end to the outlet end.

Preferably, the base is in use inclined by at least 4° to the horizontal.

Preferably, the ball feeder also comprises a scoop for receiving a single transverse row of balls at the outlet end of the funnel and means for raising the scoop into an elevated position in which it defines a second ramp extending transversely of the first mentioned ramp and in which it can release the balls one at a time. In this case, the raising means may also raise and lower a tee.

The invention also resides in apparatus for automatically feeding golf balls one at a time to a tee, comprising means for detecting when a player has hit a golf ball off the tee and a ball feeder as claimed in anyone of the preceding claims for feeding a golf ball to the tee in response to the detector means.

The invention will now be more particularly described, by way of example, with reference to the accompanying drawings.

DESCRIPTION OF THE PREFERRED EMBODIMENT

Figure 1:
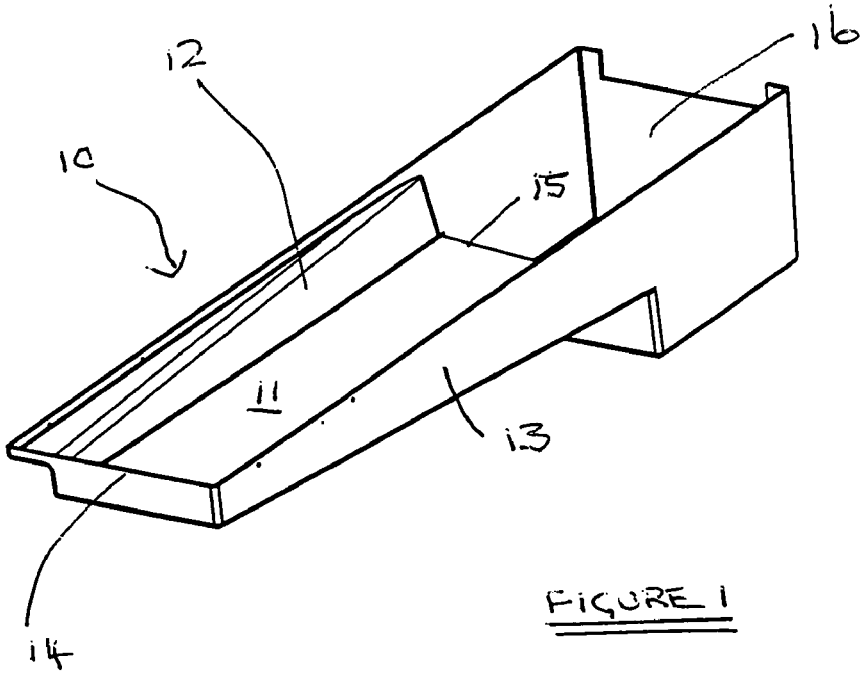
FIG. 1 is a perspective fragmentary view of one embodiment of a ball feeder according to the present invention.
Figure 3:
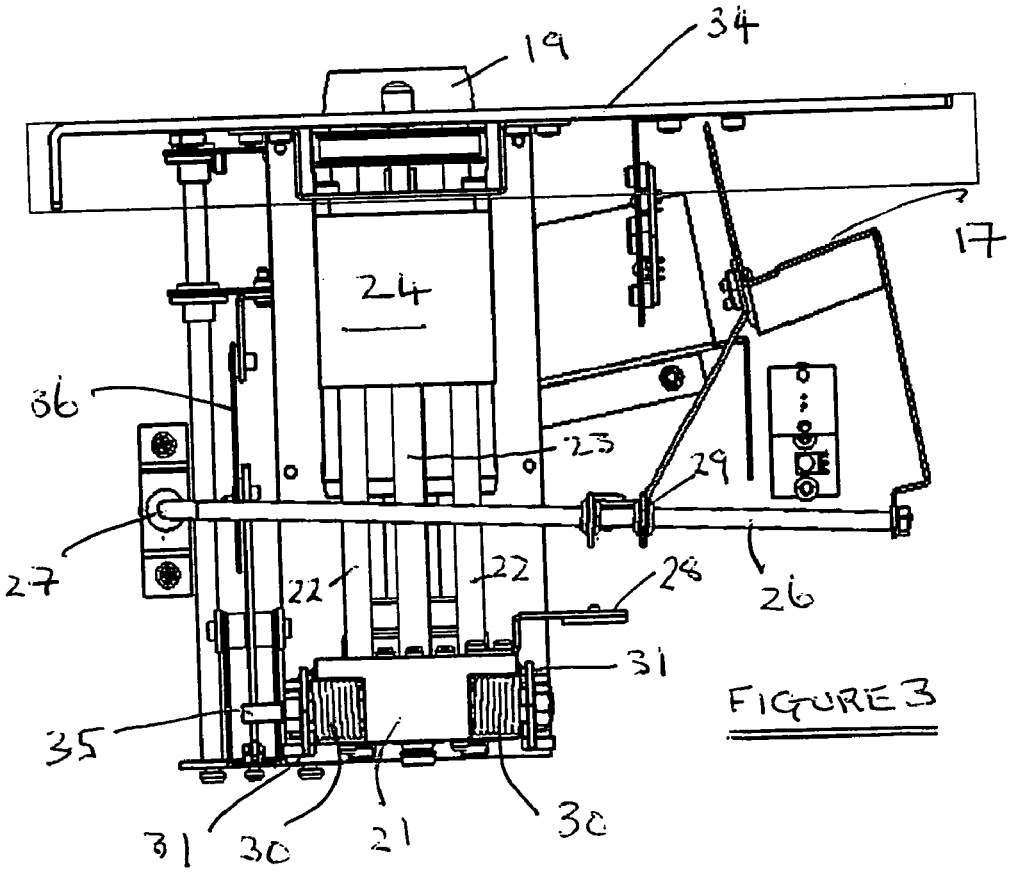
FIG. 3 is a side view of the scoop and golf ball feeding mechanism shown in FIG. 2.
Figure 2:
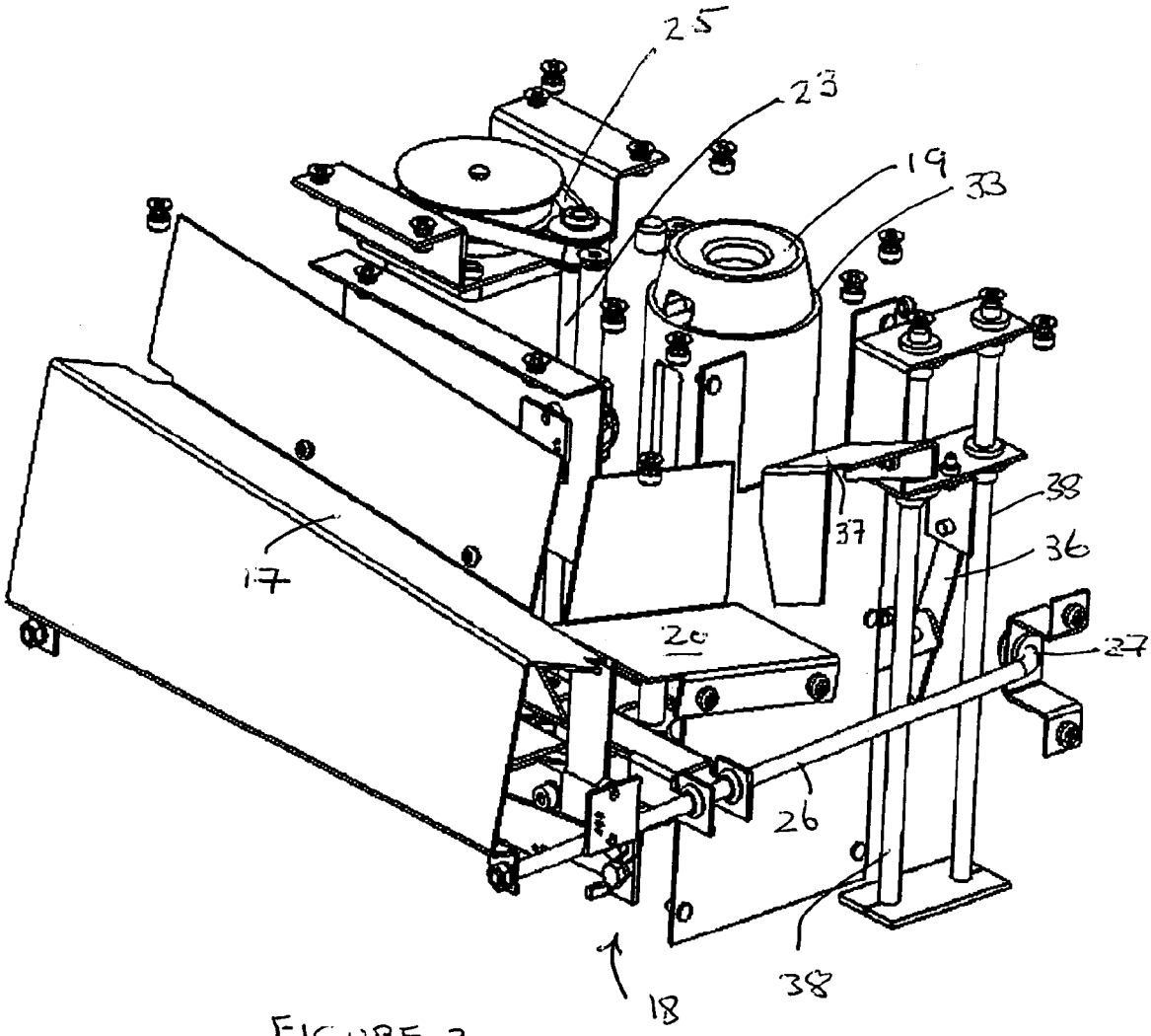
FIG. 2 is a perspective view on an enlarged scale of a scoop and golf ball feeding mechanism of the ball feeder with parts omitted for clarity.

Referring to the drawings, there is shown therein a ball feeder for feeding balls one at a time to a golf tee at a golf driving range.

The ball feeder comprises a funnel in the form of a tray 10 having a base 11, opposing side walls 12 and 13, a ball inlet end 14 and a ball outlet end 15. An open topped compartment 16 is provided at the outlet end 15 of the funnel and this compartment houses a scoop 17 and a mechanism 18 for raising and lowering the scoop and for feeding balls to a tee.

The base 11 of the funnel is inclined to define a ramp extending downwards from the inlet end 14 to the outlet end 15 in order that balls fed into the tray 10 at the inlet end 14 roll down the tray to the outlet end 15. The base 11 is inclined by at least 4° to the horizontal in order to ensure that motion is imparted to the balls.

The side wall 12 of the tray 10 is angled outwards from the inlet end to the outlet end so that it diverges relative to the side wall 13 in a downwards direction. This ensures that no balls wedge or bridge during their movement along the base 11 of the tray 10.

The balls roll onto the scoop 17 to form a single transverse row of balls and the scoop 17 is raised by the mechanism 18 to define a second ramp extending transversely of the first mentioned ramp to release the balls one at a time. The ball receiving surface of the scoop 17 is inclined in the direction in which the balls travel down the tray 10 at the same or at a similar angle to the base 11 of the tray 10 and is also inclined in a transverse direction to encourage balls to roll one at a time onto a third fixed ramp 20 when the scoop 17 is in a raised position.

The mechanism 18 comprises a carriage 21 which can be raised and lowered along a pair of spaced guide rods 22 by a threaded spindle 23 rotated by a motor 24 connected to the spindle by a belt drive 25. The scoop 17 is mounted at the free end of each of a pair of arms 26 pivoted at 27. The arms 26 are spring urged upwardly. An arm 28 on the carriage 21 engages a part 29 of the support structure for the scoop 17 to lower the scoop 17 with the carriage 21. As the carriage 21 moves upwards the scoop 17 follows it until the scoop 17 reaches its raised position.

The carriage 21 is connected via torsion springs 30 and a pair of torsion arms 31 to a tee (not shown) housed within a tee shield 19. The tee is urged downwards within the tee shield 19 and is raised as the carriage 21 is raised. During upwards movement of the carriage 21, an annular shoulder 33 on the tee shield 19 engages a support surface 34 forming part of the housing for the mechanism 18 thus preventing further upward movement of the tee shield so that the tee is driven upwards to project from the top of the tee shield 19. The torsion springs 30 provide for downwards movement of the tee relative to the carriage should someone tread on the tee.

A pin 35 projects rearwards from the carriage and makes contact with a lever mechanism 36 as the carriage is raised to lower an injector 37 along a further pair of upstanding guide rods 38.

In operation golf balls are fed into the inlet end 14 of the tray 10. They roll down the inclined base 11 of the tray and form a single transverse row of balls on the scoop 17 when the scoop is in a lowered position. As the carriage 21 is raised by the motor 24, the tee is also raised and the injector 37 is lowered. The scoop 17 is brought upwards to the level of the fixed ramp 20 and the injector 37 is brought down to the level of the fixed ramp 20 so that the injector 37 can receive a ball from the fixed ramp 20. The tee is now in a raised position so that a ball on the tee can be hit. The carriage 21 is then lowered thus lowering the scoop 17 so that it can receive another ball from the tray 10. The tee moves downwards and the injector 37 moves upwards until the top of the tee shield 19 and the injector 37 are level with one another. The ball on the injector 37 then rolls onto the tee shield in readiness for the next raising movement of the carriage 21 when the tee will collect the ball as it projects upwards from the top of the tee shield 31.

The ball feeder forms a part of apparatus for automatically feeding golf balls one at a time to a tee. This apparatus includes a ball feeder as described above and an arrangement for detecting when a player has hit a golf ball off the tee. One example of a detecting arrangement is disclosed in my co-pending British Patent Application No. 0307159.4 of even date. The mechanism 17 is operated in response to the detecting arrangement to feed a golf ball to the tee each time a ball is hit off the tee by a player.

The embodiment described above is given by way of example only and various modifications will be apparent to persons skilled in the art without departing from the scope of the invention as defined by the appended claims.

What is claimed is:

1. A ball feeder comprising:

a tray having a base and opposing side walls, the base having a ball inlet end and a ball outlet end and being in use inclined to define a first ramp extending downwards from the inlet end to the outlet end, one said side wall diverging away from the other said side wall from the inlet end to the outlet end;

a scoop for receiving a single transverse row of balls at the outlet end of the tray; and means for raising the scoop into an elevated position to release the balls one at a time, wherein the scoop, when elevated, defines a second ramp which extends transversely to the first ramp defined by the base of the tray.

2. A ball feeder as claimed in claim 1, wherein the base, when inclined, is at least 4° to the horizontal.

3. A ball feeder as claimed in claim 1, wherein the scoop raising means also raises and lowers a tee.

4. A ball feeder as claimed in claim 3, wherein the scoop raising means comprises a carriage for raising and lowering the scoop and the tee and power operated means for raising and lowering the carriage.

5. A ball feeder as claimed in claim 4, further comprising an injector and a tee shield, the injector being movable by the carriage to collect a ball raised by the scoop when the tee is in a raised condition and to deliver a ball to the tee shield when the tee is in a lowered condition.

6. Apparatus for automatically feeding golf balls one at a time to a tee, comprising means for detecting when a player has hit a golf ball off the tee and a ball feeder for feeding a golf ball to the tee in response to the detector means, the ball feeder comprising a tray having a base and opposing side walls, the base having a ball inlet end and a ball outlet end and being in use inclined to define a first ramp extending downwards from the inlet end to the outlet end, one said side wall diverging away from the other said side wall from the inlet end to the outlet end; a scoop for receiving a single transverse row of balls at the outlet end of the tray; and means for raising the scoop into an elevated position to release the balls one at a time, wherein the scoop, when elevated, defines a second ramp which extends transversely to the first ramp defined by the base of the tray.

7. A ball feeder comprising:

a tray having a base and opposing side walls, the base having a ball inlet end and a ball outlet end and being in use inclined to define a first ramp extending downwards from the inlet end to the outlet end, one said side wall diverging away from the other said side wall from the inlet end to the outlet end;

a scoop for receiving a single transverse row of balls at the outlet end of the tray;

means for feeding the balls one at a time to a golf tee; and means for raising the scoop into an elevated position to release the balls one at a time, wherein the scoop, when elevated, defines a second ramp which extends transversely to the first ramp defined by the base of the tray.

8. A ball feeder as claimed in claim 7, wherein the base, when inclined, is at least 4° to the horizontal.

9. A ball feeder as claimed in claim 7, wherein the scoop raising means also raises and lowers a tee.

10. A ball feeder as claimed in claim 9, wherein the scoop raising means comprises a carriage for raising and lowering the scoop and the tee and power operated means for raising and lowering the carriage.

11. A ball feeder as claimed in claim 9, further comprising an injector and a tee shield, the injector being movable by the carriage to collect a ball raised by the scoop when the tee is in a raised condition and to deliver a ball to the tee shield when the tee is in a lowered condition.

* * * * *